US006331220B1

(12) United States Patent
Wagaman

(10) Patent No.: US 6,331,220 B1
(45) Date of Patent: Dec. 18, 2001

(54) GAS-GENERATING LIQUID COMPOSITIONS (PERSOL 2)

(75) Inventor: Kerry L. Wagaman, Bryantown, MD (US)

(73) Assignee: The United States of America as represented by the Secretary of the Department of the Navy, Washington, DC (US)

( * ) Notice: Subject to any disclaimer, the term of this patent is extended or adjusted under 35 U.S.C. 154(b) by 0 days.

(21) Appl. No.: 09/447,272

(22) Filed: Nov. 23, 1999

(51) Int. Cl.[7] ..... C06B 31/00
(52) U.S. Cl. ..... 149/45
(58) Field of Search ..... 149/45, 46, 109.6

(56) References Cited

U.S. PATENT DOCUMENTS

| | | | | |
|---|---|---|---|---|
| H1768 | | 1/1999 | Mueller et al. . | |
| 3,145,082 | * | 8/1964 | Rausch et al. | 423/275 |
| 3,561,533 | | 2/1971 | McKinnell . | |
| 3,790,415 | | 2/1974 | Tomic . | |
| 3,923,565 | * | 12/1975 | Sakai et al. | 149/60 |
| 4,047,988 | | 9/1977 | Weill et al. . | |
| 4,507,161 | * | 3/1985 | Sujansky et al. | 149/21 |
| 5,223,057 | * | 6/1993 | Mueller et al. | 149/45 |
| 5,607,181 | | 3/1997 | Richardson et al. . | |
| 5,703,323 | * | 12/1997 | Rothgery et al. | 149/88 |

OTHER PUBLICATIONS

Anderson, W., et al. Low–Cost Propulsion Using a High–Density, Storable, and Clean Propellant Combination.
Mul. et al, Search for New Storable high Performance Propellants, (AIAA–88–3354, AIAA/ASME/SAE/ASEE 24th Joint Propulsion Conference, Boston, Jul. 1988.
Rusek, J., New Decomposition Catalysts And Characterization Techniques For Rocket–Grade Hydrogen Peroxide J. of Propulsion and Power, 1996, 12, 574–579.
A document entitled Advanced Chemical Propulsion Systems dated Nov. 21, 1995.
Berezovsky, Pyrogen Fire Suppression System–Marine & Vehicle Applications dated Aug. 1997.
Thomas, Martin, Fire Research News 20.

* cited by examiner

*Primary Examiner*—Michael J. Carone
*Assistant Examiner*—Aileen J. Baker
(74) *Attorney, Agent, or Firm*—Mark Homer

(57) ABSTRACT

A family of water-based gas-generating liquid compositions is described. A composition of the present invention includes: hydrogen peroxide; hydrazinium mononitrate; and water. Compositions of the present invention may be mixed with fuels to make monopropellants or used in bipropellant or hybrid systems. Alternative uses of the present invention include breathable gas generation.

22 Claims, 2 Drawing Sheets

Freezing Points for PERSOL 2 Formulations

GAS-GENERATING LIQUID COMPOSITIONS (PERSOL 2)

BACKGROUND OF THE INVENTION

1. Field of the Invention

The present invention relates to energetic and gas-generating compositions, and in particular to oxidizing compositions.

2. Description of the Related Art

There are numerous applications for gas-generating compositions. Energetic gas-generating compositions are commonly used, for example, in rocket propulsion systems as well as torpedoes, safety air bags, etc. Oxygen-generating compositions also have utility in breathable air generators and underwater welding.

Of particular interest among these compositions are those which are liquids, in particular liquids which are oxidizers. Liquids are necessary for many propulsion systems since they can be pumped, and liquids are in general easier to handle and store than solids. The most commonly used liquid oxidizers for rocket propulsion have generally been liquid oxygen (LOX), inhibited red fuming nitric acid (IRFNA), hydrogen peroxide ($H_2O_2$), aqueous hydroxylammonium perchlorate (HAP) and nitrogen tetroxide (NTO). Each of these liquid oxidizers has problems associated with use. For example, LOX requires cryogenic storage and is dangerous when spilled. IRFNA, NTO and $H_2O_2$ also have handling and toxicity problems. HAP offers some advantages, but suffers from the presence of hydrochloric acid in the generated gas. Most of the liquid oxidizers in current use present a vapor toxicity or contact hazard, and are hypergolic, that is, spontaneously combusting, in the presence of fuels.

Thus, there are in fact a limited number of available choices of liquid oxidizers. That there is a need to fill the technology "gap" in liquid oxidizers of the contemporary art is seen, for example, in the following articles. In Mul, et al., Search For New Storable High Performance Propellants, (AIAA-88-3354, AIAA/ASME/SAE/ASEE 24$^{th}$ Joint Propulsion Conference, Boston, July 1988), the authors discuss the need for storable, non-cryogenic propellants with better performance properties. They discuss nitric acid, NTO and hydrazinium perchlorate as storable oxidizers.

Another problem with the available liquid oxidizers is that they are mostly limited to a single composition, and thus a single set of performance and physical properties. That is, they are not formulated to achieve different values of performance and physical parameters. Thus, variation of performance properties of propellant systems using these oxidizers can only be achieved by varying the composition of the fuel, thus limiting design options.

Anderson, W., et al., Low Cost Propulsion Using A High-Density, Storable, and Clean Propellant Combination, discuss the need for nontoxic, storable, restartable, throttleable and high density impulse systems for rocket motors. They suggest the use of high concentration hydrogen peroxide as a propellant. Although the authors describe hydrogen peroxide as nontoxic, direct human contact with hydrogen peroxide is extremely dangerous.

Rusek, J., New Decomposition Catalysts And Characterization Techniques For Rocket-Grade Hydrogen Peroxide, *J. of Propulsion and Power*, 1996, 12, 574–579, discusses the use of hydrogen peroxide as a rocket propellant, both as a monopropellant and as an oxidizer with hydrazine hydrate/methyl alcohol fuel.

Gas-generating systems in other applications also have problems associated with them. For example, chlorate-based "chlorate candle" oxygen generators are used for emergency breathable oxygen in some airplanes and in welding applications. Because of the solid nature of the sodium chlorate, many of these devices cannot be turned off once triggered, and the heat production from such a device can prove to be a fire hazard. A liquid-based oxygen generator might overcome this problem. Moreover, chlorate-based devices typically produce some byproduct chlorine, which is toxic, in the breathable gas, and do not produce any diluent for the generated oxygen.

Examples of liquid gas-generating and explosive compositions of the contemporary art are seen in the following U.S. Patents. U.S. Pat. No. 3,561,533, to McKinnell, entitled Controlled Chemical Heating Of A Well Using Aqueous Gas-In-Liquid Foams, describes a two-component hypergolic reaction system in which an aqueous foam of hydrazine or dimethylhydrazine and an aqueous foam of hydrogen peroxide are mixed. The system is used to heat oil wells.

U.S. Pat. No. 3,790,415, to Tomic, entitled Chemical Foaming And Sensitizing Of Water-Bearing Explosives With Hydrogen Peroxide, describes addition of hydrogen peroxide as a foaming agent/sensitizer to water-bearing explosives having ammonium nitrate and fuel. Here, the hydrogen peroxide is added to the thickened or emulsified explosive mixture, and decomposes in the formulation to provide oxygen bubbles for foaming before the mixture is detonated.

U.S. Pat. No. 4,047,988, to Weill et al., entitled Liquid Monopropellant Compositions, describes a monopropellant which is an aqueous solution of a secondary or tertiary amine, and an oxidizer such as perchloric or nitric acid. Hydrogen peroxide is also mentioned as a possible oxidizer. Here, the amine apparently serves as the fuel in the monopropellant. Properties of the compositions including low freezing temperature, and use as a torpedo propellant, are described.

U.S. Pat. No. 5,607,181, to Richardson et al., entitled Liquid-Fueled Inflator With A Porous Containment Device, describes an automotive airbag inflator using a monopropellant composed of a hydroxylamine nitrate (HAN)/triethanolamine nitrate (TEAN)/water system is described. A system with hydrazine and hydrogen peroxide as liquid fuel components is also mentioned. HAN is a relatively expensive component, however. Moreover, TEAN serves as a fuel in this mixture, so the mixture probably cannot serve as a general oxidant for other fuels.

In addition to the above patents, U.S. Statutory Invention Registration No. H1,768, to Mueller et al., entitled Oxidizing Agent, describes liquid oxidizers comprising water, hydroxylammonium nitrate, and ammonium nitrate or hydrazine mononitrate. Two oxidizing agents designated OXSOL 1 and OXSOL 2 are described. Discussed applications include use in gas generators for air bags, rocket propellants and torpedo propellants.

A document entitled Advanced Chemical Propulsion Systems discusses the need to replace hydrazine as a fuel, and suggests use of HAN/TEAN in a catalytic thruster. As noted above, HAN is relatively expensive, and HAN/TEAN system probably cannot be used as a general oxidant with other fuels.

An additional examples of a possible utility of a gas-generating system is seen in Berezovsky, Pyrogen Fire Suppression System-Marine & Vehicle Applications, dated August 1997, which describes a fire extinguishing system (PyroGen) which is pyrotechnic-driven. The system produces an aerosol, and the composition of the system is not disclosed.

Based on my reading of the contemporary art, I have decided that what is needed is a gas-generating liquid composition which can be used as an oxidizer, and which has low cost, low toxicity and excellent handling properties.

SUMMARY OF THE INVENTION

It is therefore an object of the present invention to provide improved gas-generating liquid compositions.

It is also an object of the invention to provide improved liquid oxidizers for use in monopropellant and bipropellant systems.

It is another object of the invention to provide improved liquid compositions for generation of breathable air.

It is yet another object of the invention to provide gas-generating liquid compositions which have low cost.

It is still another object to provide gas-generating liquid compositions from readily available components.

It is a further object to provide gas-generating liquid compositions which have low vapor and skin toxicity.

It is a yet further object to provide gas-generating liquid compositions which have a low explosion hazard.

It is a yet still further object to provide compositions having excellent handling and storage characteristics, such as low corrosivity.

It is an additional object to provide gas-generating liquid compositions which are easy to prepare.

It is a yet additional object to provide gas-generating liquid compositions allowing ready production of customized formulations.

It is a still additional object of the invention to provide a gas-generating liquid having a low freezing point.

It is yet another object of the invention to provide a gas-generating liquid which has high density and high energy density.

It is yet another object of the invention to provide a gas-generating liquid which is "green", that is, disposable without damage to the environment.

It is still another object of the invention to provide a gas-generating liquid which allows water-based cleanup of spills.

These objects are achieved in the present invention which provides a family of water-based gas-generating liquid compositions which may be used in rocket propulsion, torpedo propellants, air bags, and other applications. Applications also include use in oxygen generators and in fuel cells.

The general composition of the water-based gas-generating liquid of the present invention includes: hydrogen peroxide; hydrazinium mononitrate (HN); and water. Generally, the water concentration (that is, content) in the gas-generating liquid will be in the range of approximately 15 to 45 percent by weight (w/w-%), and the water concentration may be in the range of 20 to 35 w/w-%. Generally, the hydrazinium mononitrate concentration will be in the range of approximately 25 to 60 w/w-%, and may be in the range of approximately 35 to 60 w/w-%. The concentration of hydrogen peroxide will generally be in the range of approximately 12 to 70 w/w-% and may be in the range of approximately 25 to 50 w/w-%. The gas-generating liquid composition of the present invention may have additional components, such as a colorant, an odorant, a gelant, a thixotropic agent, a surfactant, or a burning rate modifier.

In one embodiment, the gas-generating liquid compositions of the present invention may be added to a fuel to form a monopropellant. In another embodiment of the present invention, the gas-generating liquid composition may consist essentially of hydrogen peroxide, hydrazinium mononitrate and water. Here, "consists essentially of" means that this composition has no added fuel, nor other component substantially affecting the energy content, freezing point, or density of the composition. Such a composition may have minor additional components, such as a colorant, an odorant, a gelant, a thixotropic agent, a surfactant, or a burning rate modifier, which do not substantially affect these parameters.

In addition to the compositions of the present invention, the invention also includes methods of use of the compositions. Specifically, the compositions of the present invention can be used for generating gas by passing the compositions through a solid catalyst bed, heating the compositions, or adding catalyst to the compositions. The compositions can also be mixed with a fuel to form monopropellants or can be used in bipropellant and hybrid rocket systems.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
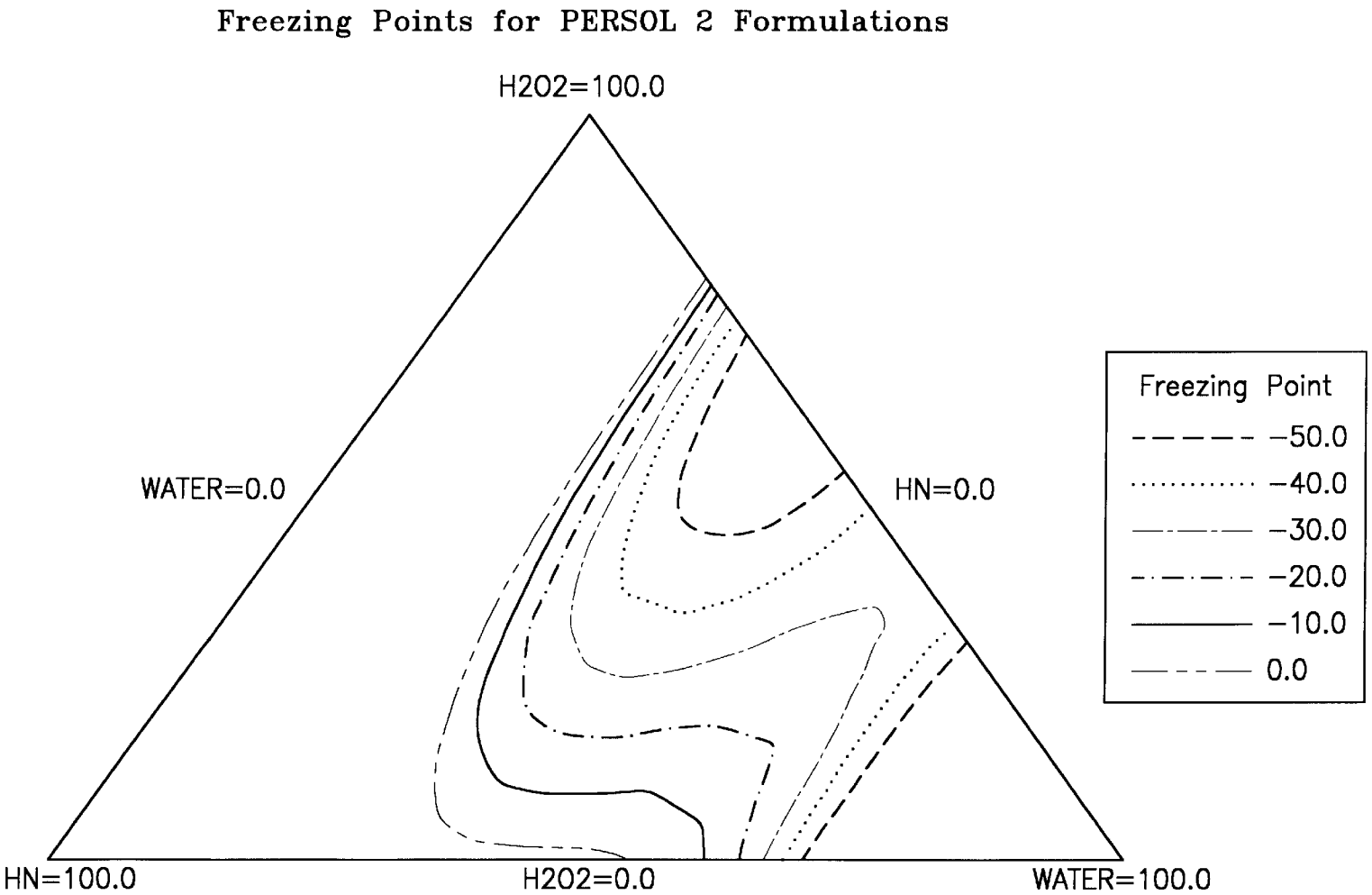
FIG. 1 is a response surface diagram illustrating freezing points of compositions of the present invention.

The gas-generating liquid compositions of the present invention are a family of compositions which the inventor refers to as PERSOL 2. The general composition of the water-based gas-generating liquid of the present invention includes: hydrogen peroxide; hydrazinium mononitrate; and water. The invention may also comprise any of a number of additives, and may comprise a fuel.

The present invention includes a family of compositions with varying amounts of hydrogen peroxide, hydrazinium mononitrate and water. Preparation of the compositions of the present invention can generally be achieved simply by the mixing the ingredients of the invention. Generally, the water concentration (that is, content) in the gas-generating liquid will be in the range of approximately 15 to 45 percent by weight (w/w-%), and the water concentration may be in the range of 20 to 35 w/w-%. Generally, the hydrazinium mononitrate concentration will be in the range of approximately 25 to 60 w/w-%, and may be in the range of approximately 35 to 60 w/w-%. The hydrogen peroxide will generally be in the range of approximately 12 to 70 w/w-% and may be in the range of approximately 25 to 50 w/w-%. Different compositions will have different values of parameters relevant to the use of the invention, and thus customized compositions of the present invention may be prepared.

Among the advantages of the present invention are the low freezing point achievable in some compositions. An important parameter of liquid gas-generating compositions is the freezing point. At temperatures below the freezing point, solids appear in the liquid, affecting many aspects of handling the liquid, for example, the ability to pump the liquid. In the present patent application, the term "freezing point" is taken to be the temperature below which any precipitation occurs in a gas-generating liquid composition. If, repeatedly, cooling the liquid below the freezing point leads to precipitation and heating to a temperature above the freezing point allows redissolution, then the freezing point can be considered to be reasonably well defined. Generally, it is desirable that a gas-generating liquid composition be be selected to have a freezing point below the ambient temperature at which the composition will be used and stored.

In order to determine the freezing point of a compositions of the present invention, the following method is used. This method may be easily performed by one skilled in the art. A sample of the liquid composition of interest is placed in a 16-mm test tube along with the bulb of a glass thermometer of appropriate temperature range. Generally, enough liquid to give a height of ¾" is used. The bottom portion of the test tube is then placed in a dry ice-ethanol bath in a Dewar flask. The sample is cooled until crystals appear visually in the liquid sample. The test tube is then removed from the bath and is warmed as necessary with stirring by the thermometer, until the crystals redissolve, noting the temperature at which redissolution occurs. The test tube is then cooled again in the bath to the noted temperature. While stirring, the test tube is cooled until crystals appear, and then removed to allow warming and dissolution. This is performed repeatedly until the temperature where a slight cooling causes crystal formation and slight warming allows dissolution is found, and this temperature is recorded as the freezing point.

Another advantage of the present invention is the high density achievable in some of the inventive compositions. Density is an important contribution to the energy content of a given composition, as more mass per unit volume allows more chemical energy per unit volume. Likewise, greater density also allows greater amount of gas generated per unit volume of liquid. Greater density thus allows for a smaller storage volume and correspondingly smaller storage tanks on the propelled vehicle, resulting in reduced weight. In the present invention, density is presented as specific gravity, that is, a unitless value relative to the density of water at 4° C. Here, densities of the liquid compositions are measured at room temperature, about 20° C., using a commercial hydrometer, by method well known in the art.

In Table I, freezing-point data and density data for selected compositions of hydrogen peroxide, hydrazinium mononitrate and water. The table includes some data for compositions with no hydrogen peroxide or hydrazinium mononitrate for comparison to compositions of the present invention.

TABLE I

Observed Freezing Point and Density for Various Compositions of Hydrogen Peroxide, Hydrazinium Mononitrate and Water

| Hydrogen Peroxide | Hydrazinium Mononitrate | Water | Density (g/cc) | Freezing Point ° C. |
|---|---|---|---|---|
| .000 | .650 | .350 | 1.340 | 11 |
| .000 | .500 | .500 | 1.255 | 0 |
| .000 | .400 | .600 | 1.18 | −7 |
| .000 | .247 | .753 | 1.12 | −7 |
| 0.35 | 0 | 0.65 | 1.133 | −31 |
| 0.322 | 0.059 | 0.619 | 1.155 | −29 |
| 0.3 | 0.105 | 0.595 | 1.171 | −27 |
| 0.28 | 0.147 | 0.573 | 1.186 | −27 |

TABLE I-continued

Observed Freezing Point and Density for Various Compositions of Hydrogen Peroxide, Hydrazinium Mononitrate and Water

| Hydrogen Peroxide | Hydrazinium Mononitrate | Water | Density (g/cc) | Freezing Point ° C. |
|---|---|---|---|---|
| 0.263 | 0.183 | 0.554 | 1.199 | −25 |
| 0.247 | 0.216 | 0.537 | 1.21 | −25 |
| 0.233 | 0.244 | 0.522 | 1.22 | −25 |
| 0.221 | 0.27 | 0.509 | 1.229 | −25 |
| 0.21 | 0.293 | 0.497 | 1.237 | −25 |
| 0.2 | 0.314 | 0.486 | 1.246 | −24 |
| 0.191 | 0.333 | 0.476 | 1.254 | −23 |
| 0.183 | 0.351 | 0.467 | 1.259 | −23 |
| 0.175 | 0.367 | 0.459 | 1.265 | −23 |
| 0.168 | 0.381 | 0.451 | 1.269 | −22 |
| 0.162 | 0.395 | 0.444 | 1.274 | −21 |
| 0.156 | 0.407 | 0.437 | 1.279 | −21 |
| 0.15 | 0.419 | 0.431 | 1.282 | −22 |
| 0.5 | 0 | 0.5 | 1.191 | −50 |
| 0.462 | 0.056 | 0.462 | 1.21 | −45 |
| 0.429 | 0.105 | 0.467 | 1.224 | −50 |
| 0.4 | 0.147 | 0.453 | 1.236 | −48 |
| 0.375 | 0.183 | 0.442 | 1.248 | −48 |
| 0.353 | 0.216 | 0.431 | 1.253 | −45 |
| 0.333 | 0.244 | 0.422 | 1.267 | −40 |
| 0.316 | 0.27 | 0.414 | 1.271 | −38 |
| 0.3 | 0.293 | 0.407 | 1.278 | −38 |
| 0.286 | 0.314 | 0.4 | 1.282 | −36 |
| 0.273 | 0.333 | 0.394 | 1.287 | −35 |
| 0.261 | 0.351 | 0.389 | 1.292 | −32 |
| 0.25 | 0.367 | 0.394 | 1.296 | −35 |
| 0.24 | 0.381 | 0.379 | 1.303 | −33 |
| 0.60 | 0.103 | 0.297 | 1.317 | −60 |
| 0.525 | 0.181 | 0.294 | 1.336 | −34 |
| 0.467 | 0.241 | 0.292 | 1.343 | −22 |
| 0.42 | 0.289 | 0.291 | 1.344 | −26 |
| 0.382 | 0.329 | 0.29 | | |

The freezing point data of Table I were statistically analyzed and fitted to a cubic model, using the commercially available computer program STATGRAPHICS. Statistical analysis and response surface modeling of this sort is well known in the art. A ternary composition response surface diagram of freezing points for those compositions of the present invention having only the three ingredients is presented as FIG. 1. It is evident from the data presented that the freezing points of compositions of the present invention are not readily predictable from only a few data of widely spaced points on the ternary response diagram. The freezing point properties of these compositions could not have been predicted without experimentation using current methods of the art. However, by obtaining sufficient data on a variety of compositions, one skilled in the art should be able to identify compositions of the present invention having freezing points below −5° C. or alternatively below −40° C., as desired. For example, a freezing point of −5° C. might be suitable for space flight applications, but a freezing point of −40° C. might be desirable for military applications in harsh environments.

Figure 2:
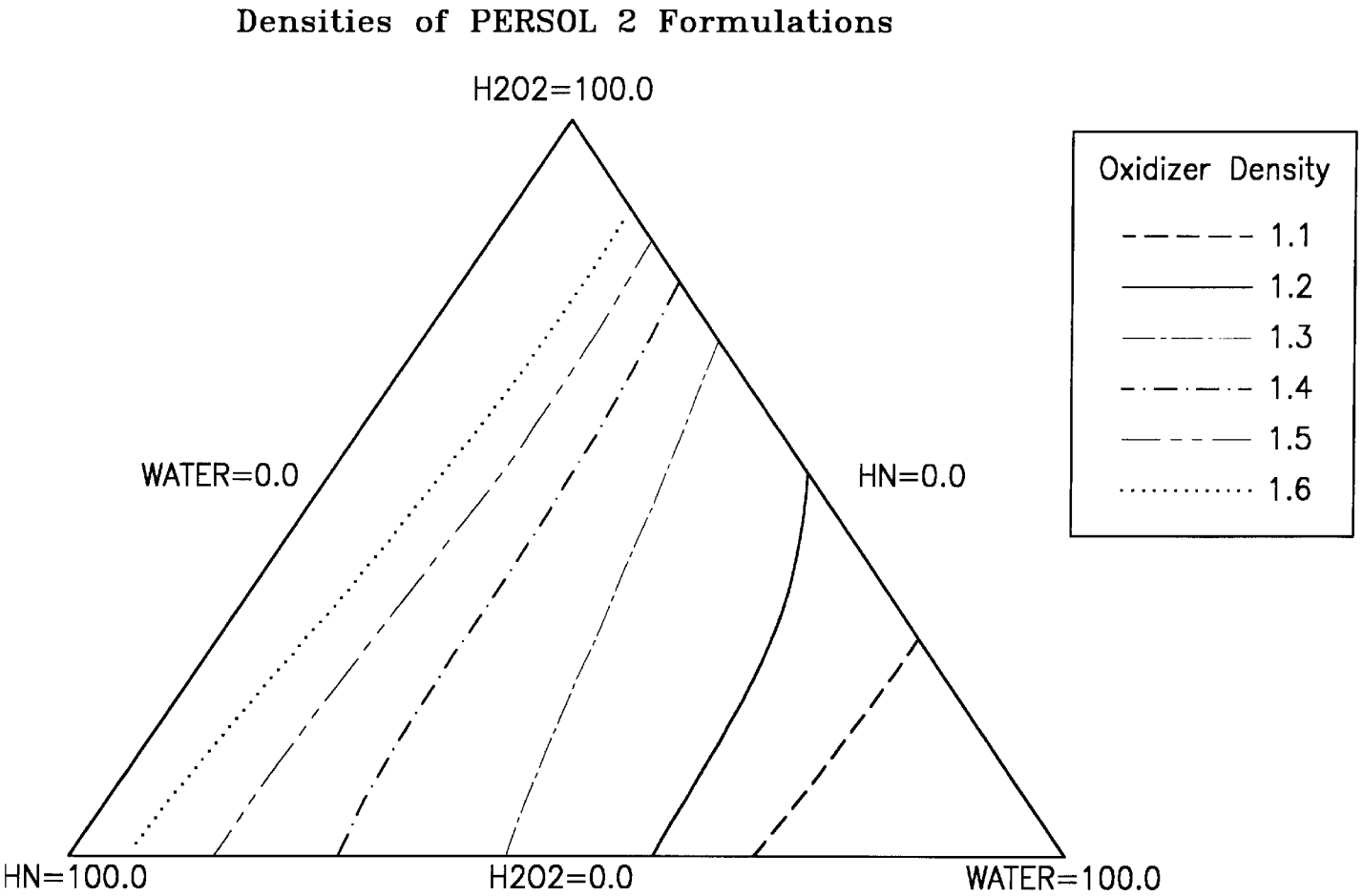
FIG. 2 is a response surface diagram illustrating densities of compositions of the present invention.

The density data of Table I were likewise analyzed and fitted to a cubic model. A ternary composition response surface diagram of densities of compositions of the present invention is presented as FIG. 2. By suitable experimentation, one skilled in the art should be able to identify compositions of the present invention with densities above 1.25, or alternatively above 1.3. The density of an energetic composition is an important parameter in the performance of the composition in propellants, with greater density generally allowing greater energy content per unit volume.

Another advantage of the present invention is the customizability of the formulation. In particular, by adjusting the water content of the final formulation, the combustion temperature can be adjusted to give a desired flame temperature or to achieve specific physical/chemical/safety properties. For example, this can reduce the vulnerability characteristics and the corrosivity/erosion problems associated with the exhaust gases.

Another advantage of the present invention is cost. Hydrogen peroxide, in particular, is relatively inexpensive.

In addition to the hydrogen peroxide, hydrazinium mononitrate and water, compositions of the present invention may also contain additives to modify other properties of the gas-generating liquids. These additives usually total less than 1 percent by weight of the composition. For example, the composition may contain a colorant. This is a dye which allows the gas-generating liquid to be more easily seen. This is particularly useful, for example, in locating spills.

Another additive which may be used is an odorant. This is a compound with an odor readily detected by the human nose, and is generally used for detecting and locating spills.

Another additive which may be used is a stabilizer. This will usually be an oxygen scavenger, such as ammonium thiosulfate, which serves to slow chemical degradation of the gas-generating liquid.

Another additive which may be used is a chelating agent, such as ethylenediamine tetraacetic acid (EDTA) or cyclohexanediaminetetraacetic acid (CDTA) or sodium salts of these compounds. Chelating agents serve to bind impurity metal ions in the liquid, and can serve to slow degradation of the gas-generating liquid.

Another additive which may be used is a gelant, or gelling agent. Having the gas-generating liquid in gel form may be useful in certain applications.

Another additive which may be used is a thixotropic agent. Such an agent can improve the general handling properties of the liquid, such as pumping or pouring.

Another additive which may be used is a burning rate modifier. Such an additive affects the kinetics, or rate of burn of compositions.

Another additive which may be used is a surfactant. Surfactants can serve to allow miscibility of the gas-generating liquid with certain fuels. Also, a surfactant can serve to modify the droplet size of the gas-generating liquid when it is sprayed, for example into a rocket combustion chamber.

The compositions of the present invention may be used as liquid oxidizers for a variety of propellant systems. In general, propellant systems are monopropellant or bipropellant systems.

In theory, a liquid monopropellant is the ideal energy source for various liquid gas generator applications such as gun propellants, air bag inflaters, torpedo propulsion and rocket motors. The monopropellant's main advantage is simplicity when compared to liquid bipropellant systems: a monopropellant requires only half the number of pumps, valves, storage tanks and pipes. An example of a monopropellant is the nitrate ester-based Otto fuel used in torpedoes.

When used as a monopropellant, a composition of the present invention would generally be preblended with a fuel. Such a fuel could be a water-soluble fuel, in which case the fuel would generally dissolve in the liquid oxidizer. Non-water soluble fuels, such as hydrocarbons, may also be used. Monopropellants using hydrocarbons and the liquid oxidizers of the present invention would generally be emulsified mixtures. In some cases, surfactants may be added to allow for better emulsification. Among the fuels that may be used with the invention are alkylammonium nitrates and alkanolammonium nitrates having one, two or three carbon atoms.

Monopropellants made using the liquid oxidizer of the present invention may be used for other purposes. If the oxidizer containing hydrogen peroxide, ammonium nitrate and water is mixed in appropriate ratio with a fuel, for example urea, an alkylammonium nitrate or hydrocarbon, the decomposition reaction can in theory yield nitrogen, carbon dioxide, carbon monoxide and water. Such a decomposition mixture would not support combustion, and might be usable in air-bag inflation, fire suppressant or related uses.

In practice, most liquid propellant systems use bipropellants. One problem with some liquid monopropellants is the low energy content of the monopropellant, in order to meet physical, chemical and safety requirements. If the oxidizer and fuel are separated, the sensitivity to shock, friction and static discharge are reduced. The homogeneous mixture of the two components of a liquid propellant has a sensitivity which is greater than that of either component.

Bipropellant systems are commonly used in rocket motors. In a bipropellant system, the liquid oxidizer contacts the fuel at the time of combustion. Rocket motors may use liquid fuel, or in the case of hybrid rocket motors, the fuel may be solid. The compositions of the present invention may be usable as liquid oxidizers for both kinds of rocket motors. Metallic additives may be added to these fuels to improve the propellants' energy outputs.

In general, catalytic or thermal combustion of an oxidizer composition of the present invention with a low-carbon content fuel should generate an exhaust gas containing $N_2$, $H_2O$, and some $CO_2$. Catalytic or thermal combustion of an oxidizer composition of the present invention should generate an exhaust gas containing $N_2$, $H_2O$, $CO_2$, CO, $CH_4$ and other gases. However, no HCN is expected in the exhaust gas, unlike exhaust gases resulting from nitrate ester fuels.

The compositions of the present invention may also be decomposed to yield gases and energy. This decomposition may be achieved by catalysis. For example, placing the composition of the present invention in contact with a fixed bed catalyst, such as Pt, Pd, or $MnO_2$, may yield decomposition. Such a reaction is well known in the art for other liquids, for example, hydrogen peroxide decomposing to water and oxygen. Alternatively, the composition of the present invention might by decomposed by adding a catalyst to the composition to dissolve or suspend the catalyst. This may be done in a catalyst stream flow process. For example, the composition of the present invention and a catalyst could be delivered from a bladder and mixed upon delivery, by methods known in the art.

Alternatively, decomposition of a composition of the present invention may be achievable by heating the composition. If, for example, the composition is injected into a hot reaction chamber, the heat of decomposition may be sufficient to self-sustain the decomposition reaction, and a continuous decomposition of a stream of the composition may be possible.

One possible application of decomposition of compositions of the present invention is in breathable air generators. Hydrazinium nitrate and hydrogen peroxide may be theoretically decomposed to oxygen, nitrogen and water according to the following stoichiometries:

$$N_2H_5NO_3 \rightarrow 0.25\ O_2 + 1.5\ N_2 + 2.5H_2O \quad (1)$$

$$H_2O_2 \rightarrow 0.5\ O_2 + H_2O \quad (2)$$

Therefore, compositions of the present invention containing hydrogen peroxide, hydrazinium mononitrate, and water can theoretically be decomposed into oxygen, nitrogen and water. Such a decomposition could be used to create a gas mixture which could be used for breathable air. Unlike chlorate-based systems, the present invention would provide a mixture of oxygen and nitrogen, which may be better for use as breathable air at atmospheric pressure than pure oxygen. Moreover, the present invention would yield no chlorine, which is a byproduct of chlorate candle systems.

In addition to the described functional properties, the compositions of the present invention also have excellent handling and safety characteristics. Because they are non-cryogenic, the problems associated with cryogenic materials are avoided. Corrosivity is also expected to be relatively low, simplifying storage and handling. Due to the water content and the use of protonated salts, the vapor pressure of toxic chemicals is extremely low in the compositions, and skin toxicity is also expected to be relatively low.

The preparation of the compositions from the constituent ingredients is relatively simple and safe, as the dissolution of the ingredients is generally an endothermic process. And, due to the water solubility of the components, water can be used in the cleanup of spills. The compositions of the invention should be readily chemically degradable or biodegradable, simplifying disposal of the compositions. The compositions of the present invention may be considered to be "green", that is, not a hazard to the environment.

Thus, the compositions of the present invention have a number of significant advantages over liquid oxidizers and other gas-generating compositions in present use.

As will be evident to those skilled in the art, various combinations and modifications can be made in light of the foregoing disclosure without departing from the spirit or scope of the disclosure. It is therefore to be understood that within the scope of the appended claims the invention may be practiced otherwise than as specifically described.

What is claimed is:

1. A water-based gas-generating liquid, comprising:

hydrogen peroxide;

hydrazinium mononitrate; and water.

2. The gas-generating liquid of claim 1, said water being at a concentration in the range of approximately 15 to 45 w/w-%.

3. The gas-generating liquid of claim 2, said water being at a concentration in the range of approximately 20 to 35 w/w-%.

4. The gas-generating liquid of claim 1, said hydrazinium mononitrate being at a concentration in the range of approximately 25 to 60 w/w-%.

5. The gas-generating liquid of claim 1, said hydrogen peroxide being at a concentration in the range of approximately 12 to 70 w/w-%.

6. The gas-generating liquid of claim 4, said hydrazinium mononitrate being at a concentration in the range of approximately 35 to 60 w/w-%.

7. The gas-generating liquid of claim 1, said hydrogen peroxide being at a concentration in the range of approximately 12 to 70 w/w-%.

8. The gas-generating liquid of claim 7, the concentration of hydrogen peroxide being in the range of approximately 25 to 50 w/w-%.

9. The gas-generating liquid of claim 1, said gas-generating liquid being characterized by having a freezing point below −5° C.

10. The gas-generating liquid of claim 9, said gas-generating liquid being characterized by having a freezing point below −40° C.

11. The gas-generating liquid of claim 1, said gas-generating liquid being characterized by having a density above about 1.25.

12. The gas-generating liquid of claim 11, said gas-generating liquid being characterized by having a density above about 1.3.

13. The gas-generating liquid of claim 1, further comprising a stabilizer.

14. The gas-generating liquid of claim 1, further comprising a chelating agent.

15. The gas-generating liquid of claim 1, further comprising a fuel.

16. The gas-generating liquid of claim 15, said fuel being a hydrocarbon fuel.

17. The gas-generating liquid of claim 16, further comprising a surfactant for solubilizing the hydrocarbon fuel or for adjusting the droplet size of the liquid.

18. The gas-generating liquid of claim 15, said fuel being an alkylammonium nitrate or alkanolammonium nitrate having one, two or three carbon atoms.

19. A water-based gas-generating liquid, consisting essentially of:

hydrogen peroxide; hydrazinium mononitrate; and water.

20. The gas-generating liquid of claim 19, said water being at a concentration in the range of approximately 15 to 45 w/w-%.

21. The gas-generating liquid of claim 19, said hydrazinium mononitrate being at a concentration in the range of approximately 25 to 60 w/w-%.

22. The gas-generating liquid of claim 19, said hydrogen peroxide being in the range of approximately 12 to 70 w/w-%.

* * * * *